United States Patent [19]

Kriege et al.

[11] Patent Number: 4,457,358

[45] Date of Patent: Jul. 3, 1984

[54] HEATING AND COOLING SYSTEM

[75] Inventors: Edward A. Kriege; Paul J. Marshall; Robert B. Tuckett, all of St. Louis, Mo.

[73] Assignee: Engineering Design and Management Inc., St. Louis, Mo.

[21] Appl. No.: 520,905

[22] Filed: Aug. 8, 1983

Related U.S. Application Data

[63] Continuation of Ser. No. 249,441, Mar. 31, 1981, abandoned.

[51] Int. Cl.[3] ..... F24F 3/00; F24D 17/02

[52] U.S. Cl. ..... 165/50; 165/63; 62/185; 62/305

[58] Field of Search ..... 62/305, 310, 304, 185, 62/177, 178, 179, 180, 181, 182, 183; 165/48 R, 50, 58, 60, 61, 62, 63

[56] References Cited

U.S. PATENT DOCUMENTS

| | | | |
|---|---|---|---|
| 2,797,068 | 6/1957 | McFarlan | 165/50 X |
| 3,276,516 | 10/1966 | Japhet | 62/185 X |
| 3,995,443 | 12/1976 | Iverson | 62/305 |
| 4,201,063 | 5/1980 | Martinez, Jr. | 62/117 |
| 4,285,392 | 8/1981 | Rannow | 165/50 |

*Primary Examiner*—Harry B. Tanner
*Attorney, Agent, or Firm*—Neal Kalishman

[57] ABSTRACT

An integrated heating and cooling system which makes maximum use of available energy regardless of seasons. The chiller is used throughout the year to transfer heat between the chilled water circuit and either the heated water circuit or the cooling tower. Also, cooling tower water can be injected directly into the chilled water circuit.

2 Claims, 3 Drawing Figures

WINTER, SPRING, FALL (UNDER 50°F WET BULB-OUTSIDE)
COOLING LOAD CONTROLLED HEAT RECOVERY

SUMMER, SPRING, FALL (OVER 50° WET BULB-OUTSIDE)
CONVENTIONAL COOLING W/HEAT RECOVERY

HEATING AND COOLING SYSTEM

This is a continuation of application Ser. No. 249,441 filed Mar. 31, 1981, now abandoned.

BACKGROUND OF THE INVENTION

I. Field of the Invention

The present invention is directed to systems for providing heating and cooling to the internal spaces of buildings. Specifically, the invention is concerned with systems that are energy efficient and that allow direct transfer of heat between the cooling tower, cold water supply circuit and hot water supply circuit.

II. Description of the Prior Art

In light of escalating fuel prices and limited availability of sources of energy, energy efficiency and savings in the heating and cooling of a building can be important in the operation of a building. It is a common practice to space heat and cool buildings by passing the building air over the media in the coils of the air handling equipment, such as blowers or induction units. The media in the blowers induction coils is heated or cooled water which is contained in closed circuits. In order to heat and cool a building two independent circuits must be employed, one for the cold water and the other for the hot water.

The temperature of the water in the hot water circuit is maintained by a boiler. The hot water circuit is primarily used in the winter for the heating of the perimeter areas of the building. It may also be used as a source of domestic hot water.

The interior temperature of a building during the summer is maintained by the cold water circuit. In the fall, spring and winter the cold water circuit serves to cool certain perimeter areas of the building and the interior sections of the building. The all-year cooling of the interior areas of the building is necessitated by the heat released by lights, people and equipment, etc. Continuous cooling is especially important in areas such as computer rooms.

The means of maintaining the temperature of the cold water circuit is usually referred to as the air conditioning or refrigeration system. The basic mechanical components of the system are cooling towers and a refrigeration unit or chiller. The chiller contains a condenser, a cooler or evaporator and a compressor. The cooler absorbs heat from the cold water line. It is transferred by a refrigerant to the condenser where it is further transferred to the cooling tower water. The heat is finally rejected from the system to the atmosphere through the cooling tower.

Several methods have been proposed for altering the aforedescribed conventional heating and cooling systems in order to achieve desired temperature effects while reducing the energy requirments of the system. These proposals have been limited in their success since they do not provide for comprehensive energy reduction. They are designed to reduce energy usage either during the winter or summer and they provide little savings during the spring and fall. Thus, their energy reduction capabilities are not broad enough to have a significant effect on overall energy usage.

Examples of such seasonal systems are illustrated by U.S. Pat. Nos. 3,995,443, Iverson, and 4,201,063, Martinez. These systems are only effective when the outside wet bulb temperature is below 55° F. They achieve their reduction in energy usage by completely bypassing the chiller. The water from the cooling towers is filtered by a strainer and then introduced directly into the pipe lines of the cold water system. The return pipes of the cold water system also feed directly into the cooling tower. These systems realize no savings during fall, spring and summer. Also, they have no effect on the energy requirements of the heating system during the winter months.

An objective of the present invention is to provide a modification of conventional building heating and cooling systems which reduce energy input. Another objective is to provide modifications of the heating and cooling systems which produce savings throughout most of the year. A further objective is to provide a heating and cooling system which minimizes energy consumption through automatic control. A final objective is to provide for the maximum utilization of the heat available in the building and transfer it to the area needed.

SUMMARY OF THE INVENTION

An internal environmental control system for a building has a means for circulating chilled water through the building and a means for circulating heated water through the building for the heating of the building. A chiller means is utilized to selectively transfer heat from the chilled water circuit to the heated water circuit or to a cooling tower means. A means is provided for selectively diverting water from the chilled water circuit to the cooling tower means. Also, a means for selectively routing water for the cooling tower means to a filtering means or to the condenser means is provided. The water exiting the filtering means is selectively routed to the compressor or the chilled water circuit and a means for selectively routing the heated water exiting the chiller means to the heated water circuit or to the cooling tower means is included.

DESCRIPTION OF THE PREFERRED EMBODIMENTS

Figure 1:
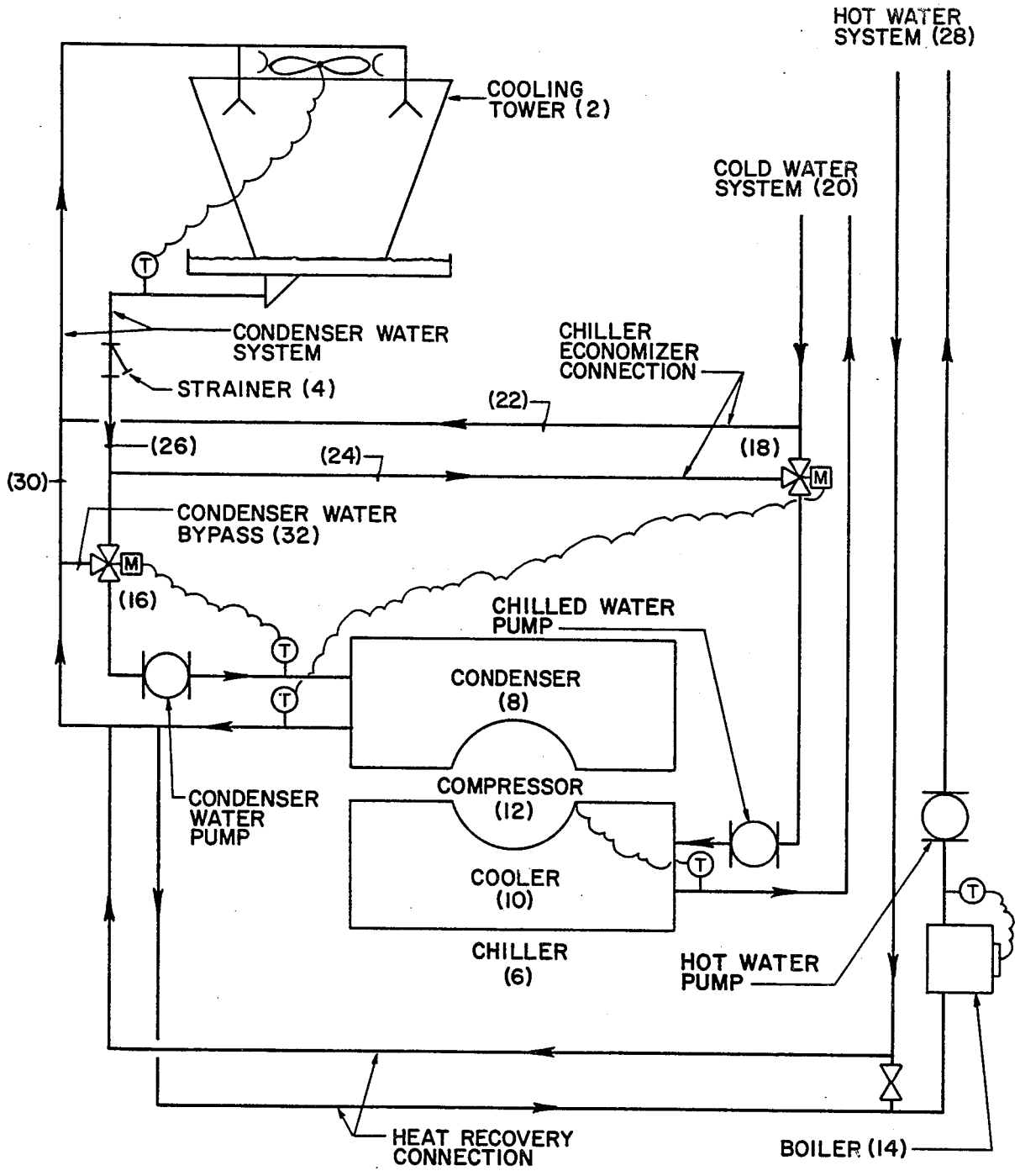
FIG. 1 is a schematic of the environmental control system of the invention.
Figure 2:
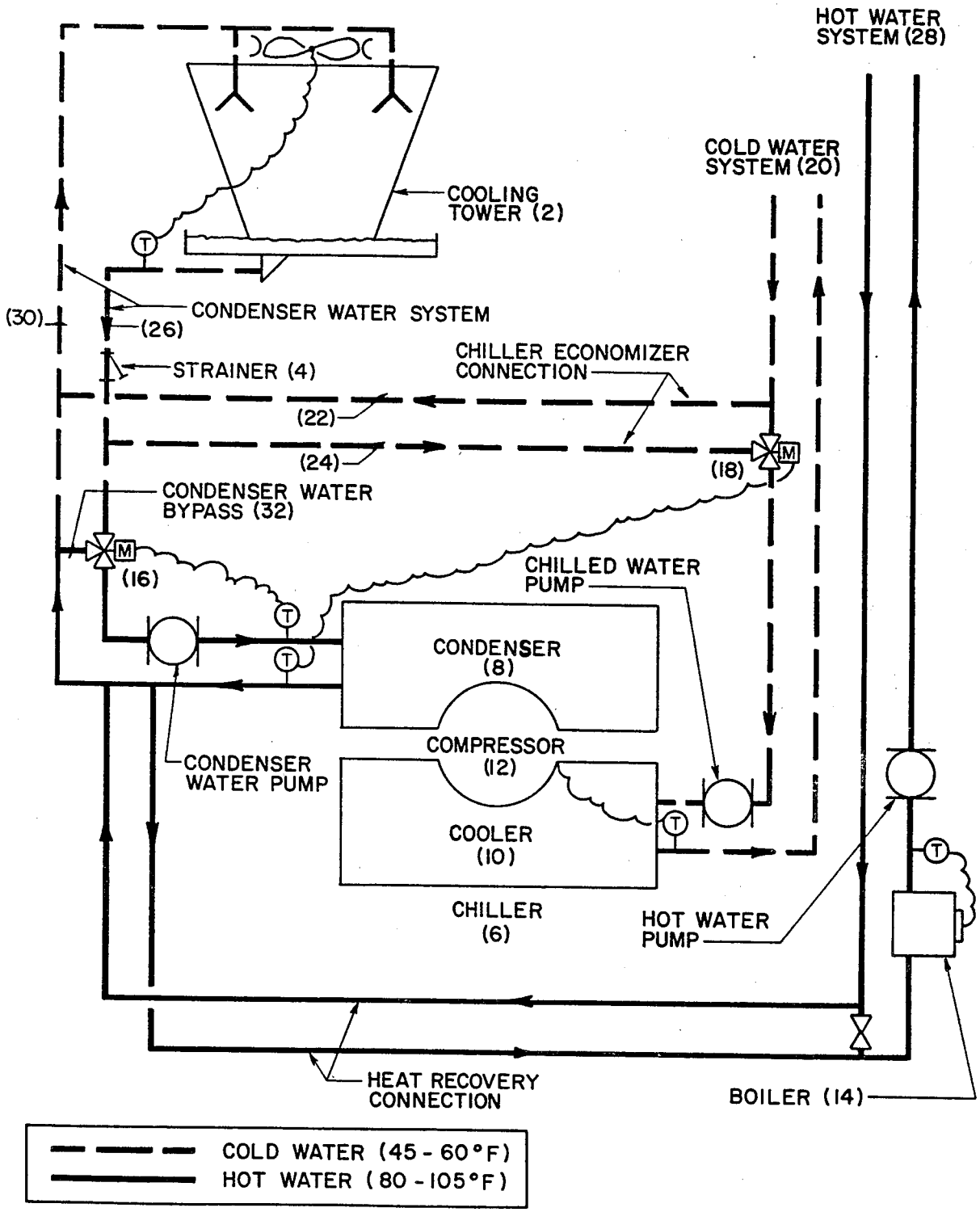
FIG. 2 is a schematic of the environmental control system of the invention emphasizing those components which function when the outside wet bulb temperature is less than 50° F.
Figure 3:
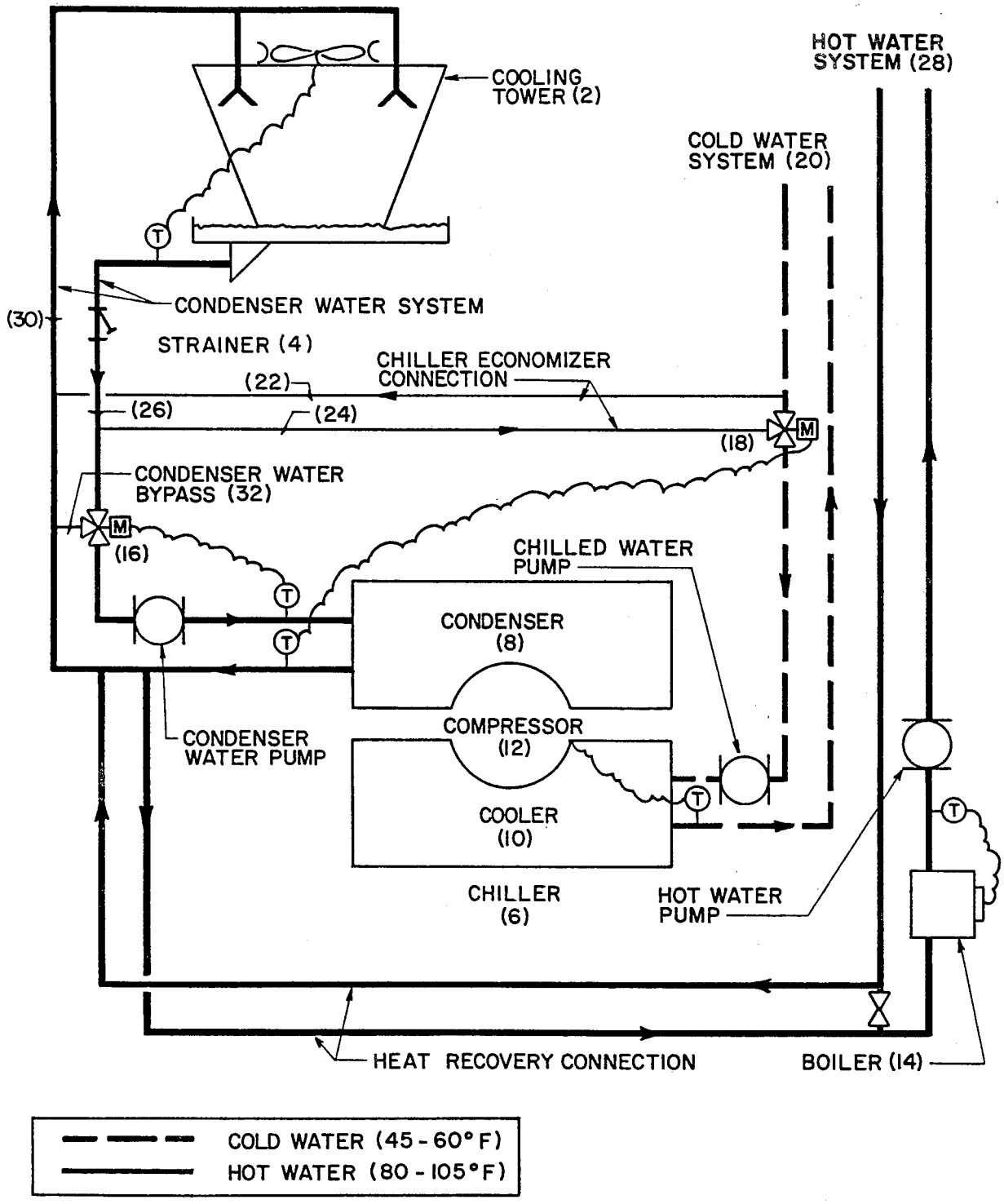
FIG. 3 is a schematic of the environmental control system of the invention emphasizing those components which function when the wet bulb temperature is greater than 50° F.

The present invention involves a unique component design for the control of the interior environment of a building. The basic components of the system as shown in FIGS. 1, 2 and 3 are cooling towers 2, cooling tower strainer or filter 4, a refrigeration or chiller unit 6 which contains a condenser 8, a cooler or evaporator 10 and a compressor 12, a boiler 14 and automatic motorized temperature controlled three-way or butterfly valves 16 and 18. Each of these components is conventional in design and it is their placement from which the invention derives its advantages. In the system the chiller unit is never totally bypassed which allows conversation of existing installations.

The refrigeration or chiller unit 6 can be of any well-known conventional design. For purposes of illustration the unit is shown comprised of a condenser 8, a cooler or evaporator 10 and a compressor 12. The system can contain a number of refrigeration units 6 in parallel or cascade arrangements depending upon the size of the units, the size of the building or the hot water system operating temperature required.

The chiller unit 6 is usually electric driven, and may have a centrifugal or reciprocating compressor 12. Chiller units are comprised of three basic components, the condenser 8, compressor 12 and cooler 10. The compressor 12 moves the refrigerant gas from the cooler 10 to the condenser 8 and at the same time compresses the gas to a pressure which will allow it to liquify when cooled in the condenser 8 to within a few degrees of the condenser water temperature. The condenser 8 is a heat exchanger with refrigerant in the shell and warm water in the tubes usually ranging from 80° to 105°. The refrigerant gas when cooled in the condenser returns to a liquid state to be piped back to the cooler. The cooler 10 likewise is a heat exchanger with refrigerant in the shell and chilled water in the tubes. The compressor 12 lowers the refrigerant pressure in this vessel which causes the liquid refrigerant to vaporize by absorbing the heat contained in the chilled water returned from the building system air handling equipment (55° to 60°). The heat extracted from the cold water is moved by the compressor 12 to the condenser 8 thus cooling the leaving chilled water to approximately 45°. Cascade chiller arrangements could take the place of the single chiller to accomplish higher hot water supply temperature (130° F.), or specially built heat recovery chillers which can achieve temperatures up to 200° F. The chilled water leaving temperature (approximately 45° F.) is established by the chiller control system by modulating the compressor 8 capacity through inlet vanes, cylinder unloading, hot gas bypass or steam input.

Absorption type chillers may be considered for this type of system and would work well. However, absorption chillers require significant high temperature heat input which is not consistent with heat recovery design logic. Air cooled chiller operation may also be used with the addition of a cooling tower, but heat recovery for distribution to hot water heating system is not possible except in the form of a desuperheater and recovery efficient is low.

The chilled water pipes or system 20 pass through the cooler 10. They also intersect water lines 22 and 24 which conduct water to and from the cooling towers 2. At the intersection of line 24 and the chilled water system is a three-way temperature controlled valve or series of butterfly valves 18.

Water line 24 is fed from line 26 which carries water from the cooling tower to the condenser. Above the intersection of these two lines is a filter or strainer 4 which cleans the water prior to its introduction in the system. The strainer 4 may be a basket type or sand type depending on the required capacity. The strainer prevents damage to the components of the chilled and heated water circuits, the cooler and boiler due to contamination and foreign objects which are picked up in the cooling tower. Return line 22 from the chilled water circuit feeds into the cooling tower return line 30.

Valve 16 is a three-way temperature control valve or a series of butterfly valves. This valve is fed from the cooling tower water line and the condenser water bypass line 32. It allows mixing of the cooling tower water from line 16 with the condenser water from the chiller or return from the hot water system through line 32 to maintain 70° to 95° water provided to the condenser. Excess hot water from the hot water system 28 may be diverted to the cooling towers 2 through line 30. The hot water circuit 28 may incorporate a boiler which may be electrical, oil or gas fired. The boiler receives water from the condenser and provides supplemental heating if necessary.

In winter the valve 16 is closed and valve 18 is opened which prevents the water exiting the cooling tower from entering the condenser and allows water from the hot water circuit to circulate through line 32 and the condenser 8. Instead the water from the coolers 2 goes through the strainer 4 and directly into the chilled water circuit. This allows an energy saving since the condenser is not being utilized to provide cooling. The chilled water circuit 20 passes through the cooler where it gives up excess heat which is transferred to the hot water circuit 28 through the condenser 8. This water may be further heated by the boiler if necessary. Supplemental heating is only necessary in colder climates. This configuration allows transfer of heat from the cold water system 20 to the hot water system 28 thereby eliminating use of the boiler. By supplying the chilled water circuit 20 with water directly from the cooling towers 2 and transferring heat from the cooled water circuit 20 to the hot water circuit 28 to the buildings energy requirements are substantially reduced.

During spring and fall when the outdoor wet bulb temperature is less than approximately 50° (the exact temperature will vary due to the system requirements) valve 16 controllably allows the introduction of cooling tower water directly into the cold water circuit. That is, the outside temperature is low enough that the condenser is partially bypassed and introduction of a portion of the cooling tower water into the chilled water line occurs. By the use of the combination approach substantial savings are rendered since the chiller unit 6 provides only a portion of the cooling requirements of the building.

During the summer season the system operates as a conventional air conditioning unit. The cooling tower water is diverted in total into the condenser. The strainer 4 can be bypassed if desired since the contaminated cooling tower water will not usually effect the condenser 8. In order to achieve maximum efficiency of the system the routing of the water within the system and opening and closing of valves can be controlled by a computer or automatic control system.

The invention affects energy and fuel savings in several respects. During the winter season heat is transferred from the chilled water circuit directly to the hot water circuit through the chiller unit. This reduces the use of the boiler. Also, the chiller does not have to operate to provide the requirements of the chilled water system. Savings are also achieved during the spring and fall period when the chilled water system receives input directly from the cooling tower and reduces the cooling loan of the chiller. Due to the systems unique configuration maximum utilization of heating and cooling capacity is achieved. The cooling tower reduces the load on the compressor by directly supplying chilled water to the cooling water circuit. Heat from the cooled water circuit is transferred to the hot water system through a heat recovery connection to the chiller instead of rejected to the atmosphere. Thus, the present invention effectively with minimal energy requirements heats and cools buildings.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. An internal environmental system for buildings which comprises:

(a) A circuit means for circulating chilled water through a building for the cooling of the building through the transfer of heat;

(b) A circuit means for circulating heated water through a building for the heating of the building through the transfer of heat;

(c) A refrigeration means comprising condenser means, compressor means and cooler means connected to the chilled water circuit for selectively transferring heat from said chilled water circuit to said heated water circuit or to a cooling tower means;

(d) A means for selectively diverting water from said chilled water circuit to said cooling tower means;

(e) A means for selectively routing water from said cooling tower means to a filtering means or to the condensor means of the refrigeration means;

(f) A means for selectively routing the water existing said filtering means to the condenser means of the refrigeration means or said chilled water circuit;

(g) A means for selectively routing portions of the water exiting the condenser means of the refrigeration means to said heated water circuit, to the cooling tower means, or back to the condenser means of the refrigeration means; and (h) A means for selectively routing portions of the water from the heated water circuit to the cooling tower means or to said condenser means wherein when the water from the heated water circuit is routed to said condenser means all or part of the water exiting said filtering means can be routed to the chilled water circuit.

2. A method of controlling the internal temperature of a building comprising:

(a) Circulating chilled water through the building in a chilled water circuit;

(b) Circulating heated water through the building in a heated water circuit;

(c) Selectively transferring heat from the chilled water circuit to the heated water circuit through a refrigeration circuit or to a cooling tower;

(d) Selectively diverting water from the chilled water circuit to the cooling tower;

(e) Selectively routing water from the cooling tower through a filter or the condenser of a refrigeration unit;

(f) Selectively routing water from the filter to the condenser of the refrigeration unit or the chilled water circuit;

(g) Selectively routing portions of the heated water exiting the condenser of the refrigeration unit to the heated water circuit, the cooling tower, or back to the condenser of the refrigeration unit; and (h) Selectively routing portions of the water from the heated water circuit to the cooling tower or to the condenser of the refrigeration unit wherein when the water from the heated water circuit is routed to said condenser all or part of the water exiting the filter can be routed to the chilled water circuit.

* * * * *